United States Patent [19]

Liebel

[11] Patent Number: 4,854,225

[45] Date of Patent: Aug. 8, 1989

[54] VENTING CONTROL DEVICE

[76] Inventor: Richard J. Liebel, 343 Norman Ave., Hatfield, Pa. 19440

[21] Appl. No.: 177,051

[22] Filed: Apr. 4, 1988

[51] Int. Cl.[4] ..... F23L 17/02

[52] U.S. Cl. ..... 98/116; 98/119; 126/286

[58] Field of Search ..... 34/235; 98/119, 59, 98/116; 126/286; 251/82, 83, 294

[56] References Cited

U.S. PATENT DOCUMENTS

| | | | |
|---|---|---|---|
| 190,181 | 5/1877 | Baker | 126/286 |
| 1,947,536 | 2/1934 | Shakespeare, Jr. | 126/286 |
| 1,968,652 | 7/1934 | Morrow | 98/119 |
| 2,733,889 | 2/1956 | Mattingly | 251/294 X |
| 2,750,869 | 6/1956 | Cole et al. | 98/119 |
| 4,691,624 | 9/1987 | Moore | 126/286 X |

*Primary Examiner*—Harold Joyce

[57] ABSTRACT

A device for controlling the venting of gases and unburned hydrocarbons from a source location into the atmosphere and includes an enhancement that prevents an entrance of cold drafts and foreign matter in a reverse direction to the source. The device may also be incorporated into a system for venting or distributing air or gases into discrete areas of a residence or commercial establishment.

7 Claims, 4 Drawing Sheets

FIG. 1
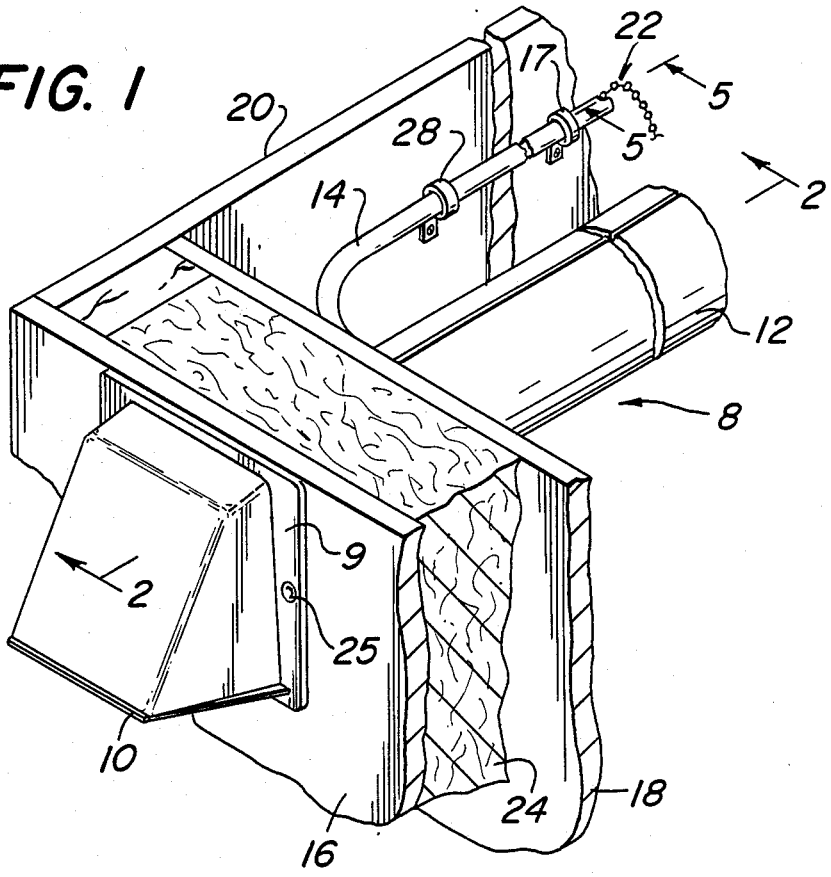
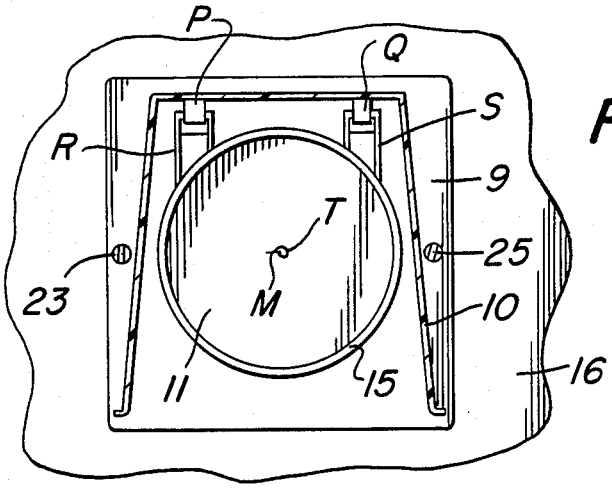
FIG. 4

FIG. 5
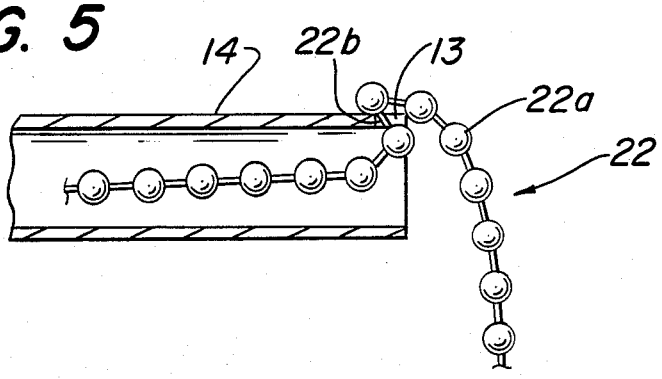
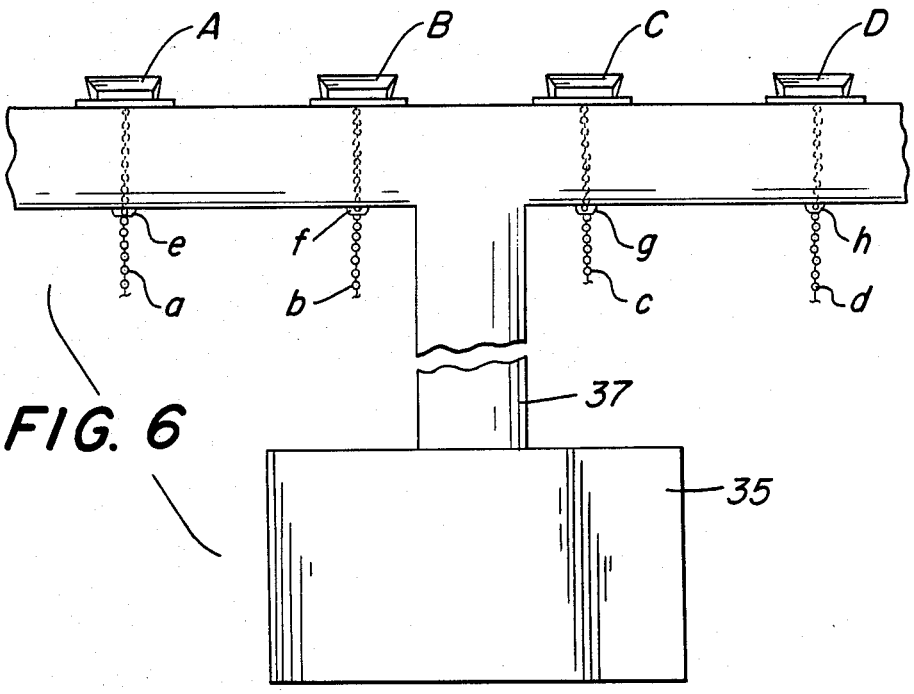
FIG. 6

VENTING CONTROL DEVICE

BACKGROUND OF THE INVENTION

1. Field of the Invention

The invention relates to the field of venting devices, and in particular, relates to the field of controlling the venting of unwanted gases from an indoor location to the atmosphere.

2. Description of the Prior Art

The known prior art systems presently in existence for venting of unclean air to improve air quality are deemed to be unsatisfactory in view of their inability to serve the dual functions of expelling undesirable air, and preventing entrance of summer heat, insects, birds, rodents and winter drafts when the system is not in use. These prior art shortfalls are significant with respect to appliances that generate smoke in the form of unburned hydrocarbons and unclean air from cooking surfaces made for barbequing and the like which are utilized in enclosed kitchen areas. These cooking surfaces normally incorporate an exhaust device positioned under the appliance for drawing cooking odors and smoke into a venting tube and then forced through a flap in an outlet vent and into the atmosphere. However, the flap associated with the vent generally remains partially open when not in use and, therefore, is deemed to be unsatisfactory due to its inability to remain sealed when not in use. The present invention overcomes the above-mentioned prior art shortcomings.

Prior art arrangements which are adapted for use as gas or fluidic distribution systems are also considered to be deficient since they require a plurality of manually operated turn valves for opening and closing purposes in order that the desired distribution takes place. The use of turning valves usually requires that an operator position himself where the valves are situated which conventionally are not centrally located, but rather are located in proximity to the desired distribution area. Such an arrangement is undesirable from a convenience and efficiency standpoint and is generally considered unsatisfactory. The present invention disclosure permits distribution by remote control which substantially augments the efficiency and convenience of the prior art systems.

SUMMARY OF THE INVENTION

The invention provides a remotely controlled venting device for use in expelling undesirable gases and unburned hydrocarbons from an enclosed area. The remote control device allows a facile opening of a hinged door when the system is being used to expel these gases and hydrocarbons to the atmosphere by use of a low friction door mechanism. The low friction mechanism is adapted to readily open to the atmosphere when the gas impinges upon the vent door after being exhausted by a blower, and also includes a sealing control for the hinged door to prevent warm or cold air and foreign matter from entering a kitchen or similar type area when the gas generating device is not in use. The venting device of the invention may also be incorporated into a distribution system for a fluidic medium to various locations.

Therefore, it is an object of this invention to provide a new and improved venting device for allowing removal of gas and smoke in the form of incomplete combustion of hydrocarbons from an enclosed facility such as a kitchen area; at the same time, the venting device permits tight sealing of the door mechanism to prevent unwanted cold air in the winter season and warm air as well as foreign matter from entering the facility. The invention also eliminates noise from being generated by a flapping vent door due to high wind conditions.

BRIEF DESCRIPTION OF THE DRAWINGS

FIG. 1 is a view of the preferred embodiment illustrating the venting control assembly of the invention.

FIG. 4 is a sectional view of FIG. 2 taken along line 4—4.

FIG. 5 is a sectional view of FIG. 1 taken along line 5—5.

FIG. 6 is a schematic view of another embodiment of the invention.

DESCRIPTION OF THE PREFERRED EMBODIMENT

Figure 2:
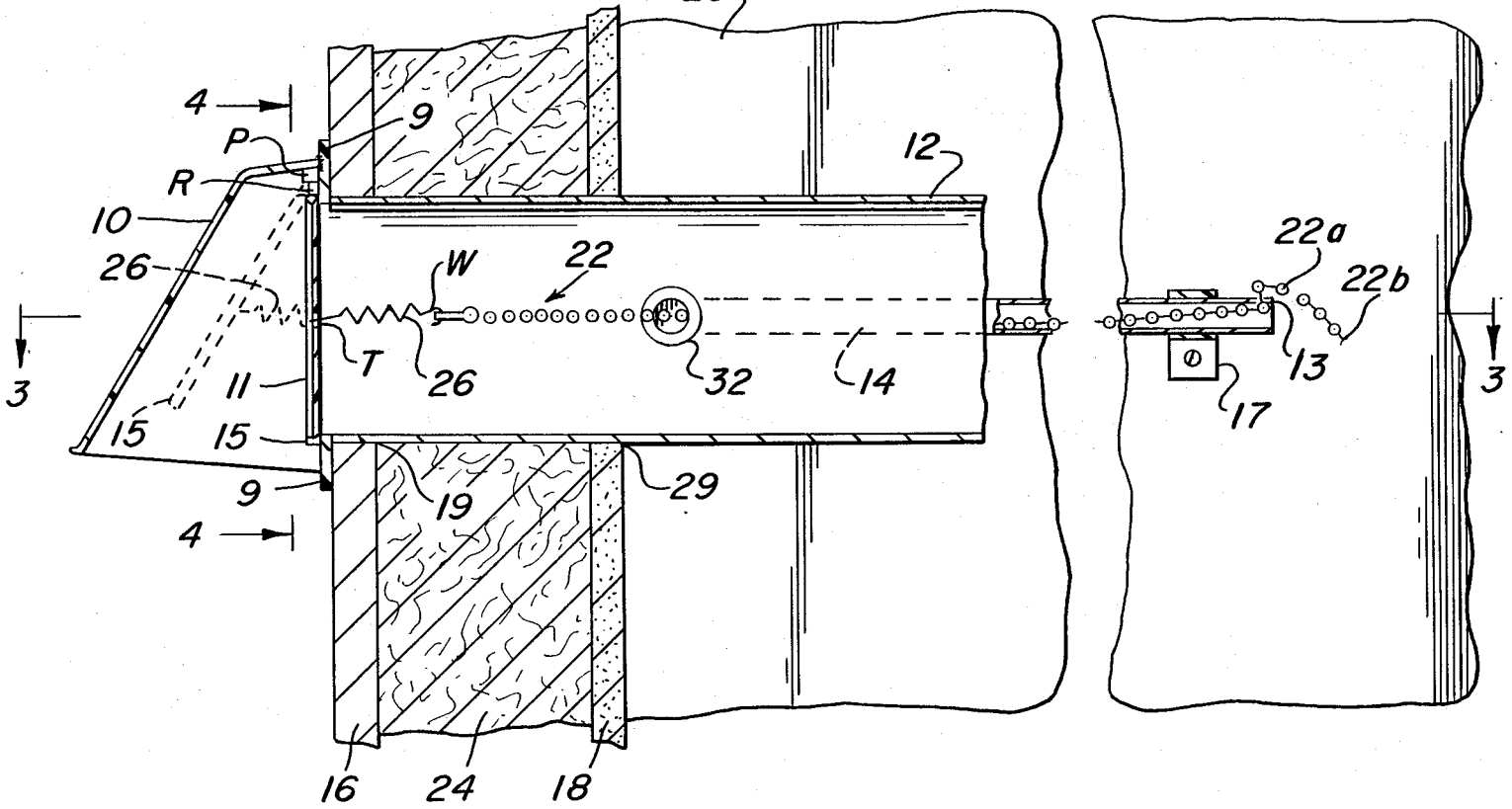
FIG. 2 is a sectional view of FIG. 1 taken along line 2—2.

Reference is made to FIG. 1 where the vent control device 8 is basically shown consisting of an outside vent 10 which is attached to an exterior wall 16 of a structure (not shown) such as a house, a horizontally disposed vent or collection pipe 12 and a tube 14 for housing a low friction chain 22. The vent 10 is fixed in position over an opening 19 (see FIGS. 2 and 3) provided in the exterior wall 16 by means of wood screws 23, 25 (see FIG. 4) which fit in holes provided in the vent flange 9. The collection pipe 12 is coupled to the vent 10 through the opening 19 as well as an opening 29 in an inside wall 18 of the structure. By referring to FIGS. 2 and 3 it is seen how the horizontally disposed collection pipe 12 after being positioned through the openings 19, 29 is butted against the flange 9 for coupling with the vent 10. As particularly depicted in cross section in FIG. 2, a circular diaphram or vent door 11 which is made of light weight plastic or metal is located over an opening existing at the end of the collection pipe 12 in the closed position, and is depicted in dotted form in the open position. The open and closed position of the diaphram 11 is attained by means of a hinging action via hinges P, Q (See FIG. 4) to which are respectively attached trunions R, S. As is well understood in the art, upper portions of the trunions R, S fit into the respective hinges P, Q, whereas, the lower portions are attached to the diaphram 11 in order to attain the desired hinging action. The diaphram 11 includes a circular bead 15 for reinforcing its circumferential dimension in view of its light weight construction. The diaphram 11 includes a center opening T for receiving a hook M (See FIG. 3) at the end of spring 26 as will be discussed in greater detail hereinbelow.

In one exemplary application of the vent control device of the invention 8, the right end of the collection pipe 12, as viewed in FIG. 1, is connected to an exhaust end of a blower (not shown) which is positioned below an indoor rotisserie (not shown) located on a counter top (not shown) in a kitchen area. An intake end of the blower is located under the rotisserie in order to capture undesirable smoke, gases and unburned hydrocarbons which are generated during the cooking and in particular barbecuing process. In order to allow the smoke and gases to readily escape into the atmosphere through the vent 10 a low friction control mechanism is provided for the vent device 8 for facilitating the operation of the diaphram 11. The low friction control mechanism consists essentially of a metal tube 14 which is attached to the interior wall 20 of a kitchen cabinet by means of straps 17, 28 and a ball chain 22 of light weight located within the interior of the tube 14. The chain 22 consists of a plurality of equally spaced, metallic and hollow balls 22*a* positioned upon a link member 22*b*. The arrangement of the chain 22 within tube 14 may be clearly visualized by referring to the sectional views in FIGS. 2 and 3.

Figure 3:
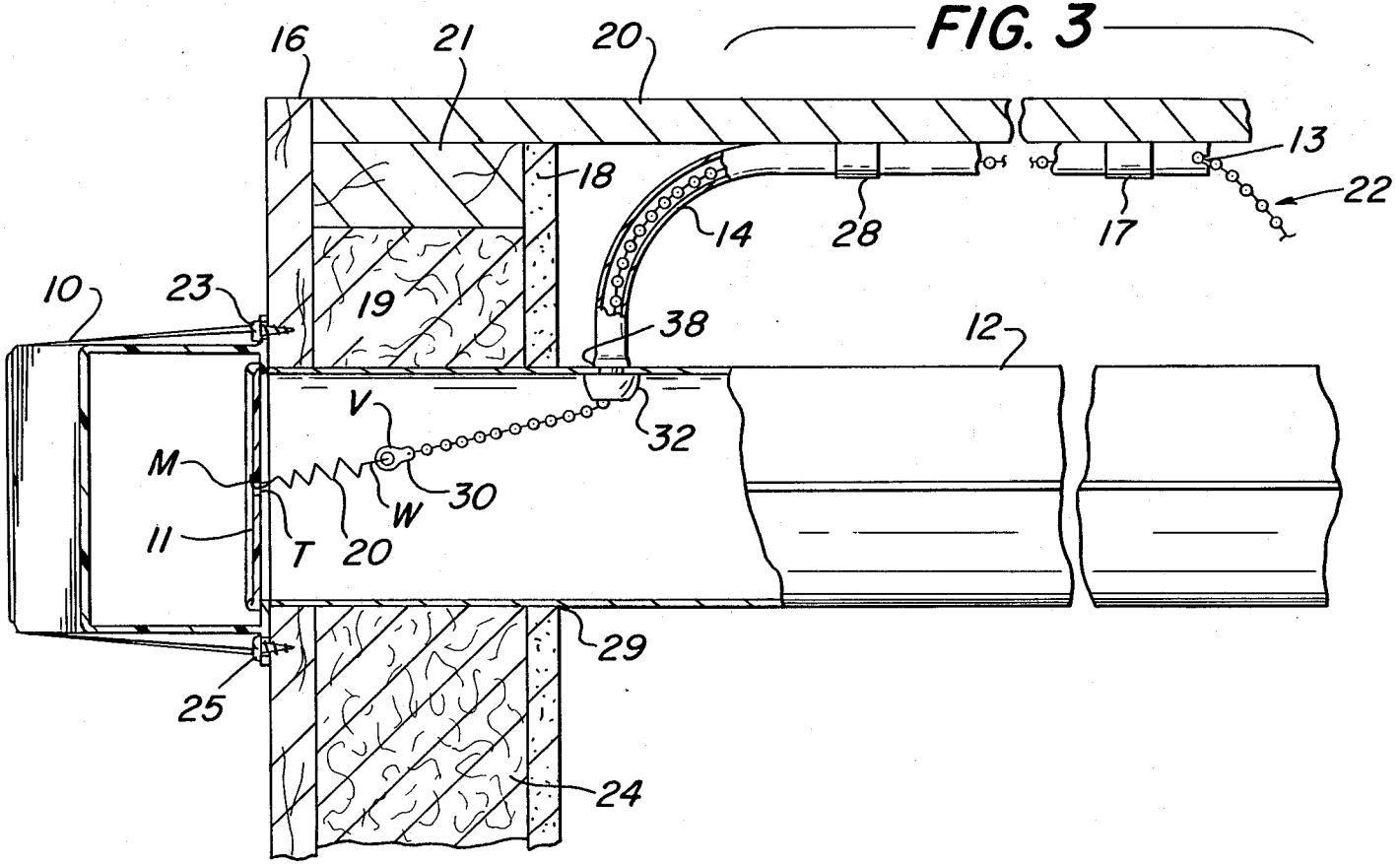
FIG. 3 is a sectional view of FIG. 2 taken along line 3—3.

In FIG. 3 the tube 14 is shown in a bent position for entering at a right angle into an opening provided in the side of collection pipe 12. The end of tube 14 which is adapted to enter the collection pipe opening is equipped with an integrally formed shoulder 38. A metal cone-shaped member 32 is also integrally formed onto the tube 14 and is adapted to receive a nylon bushing (not shown) whose purpose will become apparent in the discussion hereinbelow. The metal cone-shaped member 32, which projects into the collection pipe 12, aids in providing a smooth transition for the chain 22 when it bears leftwardly for connection to the diaphram 11. As seen in FIG. 3, the chain 22 is threaded through the tube 14 beginning from the right as viewed in FIG. 3 and enters into the collection pipe 12 through an opening provided in the cone member 32 for eventual attachment to the diaphram 11 at the left of the drawing. The sectional views of FIGS. 2 and 3 depict the chain 22 connected to the diaphram 11 which is in a closed and sealed position against the flange 9. The chain 22 is connected to the diaphram 11 via a spring 26 and metallic ringlet 30. One end of the spring 26 includes the hook M which is inserted in the center opening T provided in the diaphram 11, whereas, the other end includes a hook W which is inserted into the hole V in the ringlet 30. A small opening is also provided at an end opposite from the hole V for connection with an end of the chain 22 in order to integrally connect the chain 22 with the ringlet 30.

In operation, when the vent control device 8 is placed in a non-venting state or no smoke or gases are being generated in the kitchen area from the rotisserie, the diaphram 11 is conventionally in a closed and sealed position to the atmosphere in order to prevent either cold from entering into the kitchen area during the winter season, or alternatively, in the summer to prevent insects and warm air from entering in the event that the area is being air conditioned. The invention is particularly adapted to prevent warm or cold drafts as well as insects from upsetting the kitchen environment by tightly sealing the diaphram 11 against the flange 9; furthermore, the invention prevents flapping of the diaphram 11 during high wind conditions. This is accomplished by a person within the kitchen area opening the cabinet door where an end of the chain 22 can be readily accessed by grasping and pulling thereon to apply tension against the spring 26. The pulling upon the chain 22 causes the spring 26 to stretch and the diaphram 11 to provide the sealing action against the flange 9. In order to maintain the sealing action over a period of time the spring 26 is maintained in tension by pulling on the chain and firmly maintaining this position by locating it in a notch 13 provided in tube 12 as can be seen in FIGS. 2 and 3. This notching action may be further appreciated by referencing FIG. 5 where it is shown that the portion of the link 22*b* between two consecutive balls 22*a* is positioned within the notch 13 so that the chain 22 is held rigid in a locked position. As understood, the chain 22 is maintained in a rigid status since the spring 26 is under tension and therefore exerts a leftwardly acting force upon the chain 22 which is semi-permanently locked within the notch 13. The remainder of the chain 22 beyond the notch 13 is not acted upon by the spring 26 and therefore hangs limp in a downward position.

It should be noted that FIG. 2 also depicts in solid lines the operation of the spring 26 under tension in combination with the rigidly notched chain 22 for sealing the diaphram 11; however, the diaphram 11 is also depicted in dotted form in an open position when the spring 26 is not under tension. When the spring 26 is not under tension the chain 22 is separated from the notch 13 (not shown) so that it lies limp within the tube 14 and the diaphram 11 is free to open when a down draft is being generated within the collection pipe 12. An external force produced by the down draft results from the movement of gases and unburned hydrocarbons generated by the energizing of the blower at the end of the collection pipe 12 when a person in the kitchen is utilizing the rotisserie. .Therefore, the down draft that is created impinges upon the light weight diaphram 11 which readily opens in view of the low friction drag that is created between the hollow metallic balls 22*a* comprising the chain 22 and the metallic tube 14. Also, low friction is created between the chain 22 and the cone 32 via the internally positioned nylon bushing. It is understood that when the rotisserie is no longer being used, the end of the chain 22 can again be gripped in a manner to apply tension to the spring 26 by stretching through a pulling action, and accordingly diaphram 11 is sealed against the flange 9; and in the manner previously described, the chain 22 maintains tension on the spring 26 by placing the link 22*b* between two consecutive balls 22*a* in the notch 13. A desirable feature of the vent device 8 is that the low friction control arrangement allows the chain 22 to operate over a relatively long run so that the rotisserie can be located on a island in the middle of a ktichen area without diminution of performance.

The vent control device 8 as shown in FIGS. 2, 3 incorporate a safety feature in the form of the spring 26 whose spring rate is selected to allow blower pressure which is generated in pipe 12 to over-ride spring tension allowing diaphram 11 to partially open when the chain 22 is left in the locked position on notch 13. As understood, there is a release of gases and unburned hydrocarbons sufficient to prevent eye and lung irritation, and to alert the equipment operator that the chain 22 has not been unlocked from the notch 13.

Another embodiment utilizing the vent control device 8 previously described is illustrated in FIG. 6 of the drawings. The embodiment illustrates an air conditioning unit 35, for example, which is connected to a plenum 37 that receives the generated cool air for distributing through exit orifices to various locations, such as rooms or areas in a room, house or commercial establishment. Several vent control devices A, B, C and D of the invention, which are located in juxtaposition with one another in a centrally located area, are placed along the plenum 37 for distribution of the cold air to certain locations. In normal practice the plenum is suspended from a ceiling for refrigerated air distribution so that the cool air which is denser than air at warmer ambient temperature can cool a room or area more efficiently. If it is desired that a certain room or area be cooled one of the chains a, b, c, d associated with the room or area in question is released from its respective notch e, f, g, h so that the generated cool air by the air conditioner 35 can impinge upon the light weight diaphram (not shown) and readily open due to the low friction chain assembly previously described. In like manner, when the cool air is not to be distributed to a certain room or area, the vent control device 8 of the invention allows tight sealing of the diaphram against a flange (not shown) as previously described so that no cool air may escape. Hence, the distribution becomes very efficient because there is minimal air leakage. Although the embodiment of FIG. 6 is described with respect to cool air it is readily apparent that the invention would be also applicable to warm air distribution.

The invention described in FIGS. 1 to 6 is also adaptable to other applications such as venting steam generated during the process of drying wet clothing in a home or commercial dryer. Therefore, the invention is adaptable to any application wherein a gaseous fluid must be expelled and other type of fluids are prevented from entering when the process being utilized is not in use.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A system for expelling a fluid via a blower and including a collection means for directing said fluid into a venting means having a hinged closure means into the atmosphere, the improvement comprising:

(a) means in a form of a relatively long tube and having a first and second terminus connected into an opening provided by said fluid collection means;

(b) retention means formed in said tube means at its first terminus;

(c) a single spring means having a specified spring rate directly connected to said hinged closure means;

(d) means positioned internally said tube means adapted to attach to said retention means and connected to said hinged closure means through said spring means, wherein said internally positioned means and said tube means comprise a low friction control means for opening said hinged means after said internally positioned means is released from said retention to cause said spring means to assume an unstretched state, and for allowing a facile expelling of said fluid into the atmosphere upon impinging upon the hinged means, and (e) said internally positioned means being pulled against said spring means for placing said last mentioned means under tension by stretching a specified amount to obtain a sealing action of said hinged closure means against said venting means, and retaining said sealing action by engagement of said internally positioned means with said retention means; and (f) said hinged closure means being partially opened to the atmosphere by an additional second stretching of said spring means due to an increase in fluid back pressure caused by gases and unburned hydrocarbons in said collection means; and (g) said second stretching of said spring means and partial opening acting as a safety enhancement.

2. The system in accordance with claim 1 wherein said fluid comprises unpurified air.

3. The system in accordance with claim I wherein said fluid comprises unsaturated steam.

4. The system in accordance with claim I wherein said long tube comprises a metallic pipe means.

5. The system in accordance with claim 4 wherein said low friction means comprises:

a plurality of equally separated and hollow metal balls formed on a linking means operating within said pipe means.

6. The system in accordance with claim 5 wherein said retention means comprises:

a notched means formed at a terminus of said enclosure means for receiving said ball chain to prevent its further displacement.

7. The system in accordance with claim 6 wherein said tension spring is characterized by a spring rate which after release of said chain means from said notched means allows a down draft of said fluid to open said hinged closure means, and further characterized by allowing said tension spring to be stretched by pulling upon said internally positioned means for sealing said hinged means against said venting means.

* * * * *